US007219768B2

(12) United States Patent
Climenhaga

(10) Patent No.: US 7,219,768 B2
(45) Date of Patent: May 22, 2007

(54) MULTIPLE LOCKING POSITION SAFETY LEG FOR LIFTS

(75) Inventor: Douglas W. Climenhaga, Sycamore, IL (US)

(73) Assignee: SVI Inc., Aurora, IL (US)

( * ) Notice: Subject to any disclaimer, the term of this patent is extended or adjusted under 35 U.S.C. 154(b) by 325 days.

(21) Appl. No.: 10/798,042

(22) Filed: Mar. 11, 2004

(65) Prior Publication Data

US 2005/0224769 A1 Oct. 13, 2005

(51) Int. Cl.
*B66F 7/10* (2006.01)

(52) U.S. Cl. ..... 187/207; 187/203; 187/204; 187/208

(58) Field of Classification Search ..... 187/203, 187/204, 205, 206, 207, 208, 356
See application file for complete search history.

(56) References Cited

U.S. PATENT DOCUMENTS

| | | | | | |
|---|---|---|---|---|---|
| 2,935,049 | A * | 5/1960 | Krenning | 188/67 |
| 3,013,635 | A * | 12/1961 | Racely | 187/206 |
| 3,056,468 | A * | 10/1962 | Jaseph | 187/206 |
| 3,088,546 | A * | 5/1963 | Ross et al. | 187/206 |
| 3,098,542 | A * | 7/1963 | Wallace et al. | 187/206 |
| 3,539,036 | A * | 11/1970 | Halstead | 187/220 |
| 4,050,545 | A * | 9/1977 | Hunter | 187/204 |
| 4,078,676 | A * | 3/1978 | Mortenson | 414/558 |
| 4,491,194 | A * | 1/1985 | Mountz | 187/204 |
| 5,709,286 | A * | 1/1998 | Mead et al. | 187/205 |
| 5,803,206 | A * | 9/1998 | Halstead et al. | 187/208 |
| 5,860,491 | A * | 1/1999 | Fletcher | 187/203 |
| 6,382,358 | B1 * | 5/2002 | Kritzer | 187/208 |
| 6,446,757 | B1 * | 9/2002 | Taylor | 187/208 |
| 2003/0122351 | A1 * | 7/2003 | Yeh | 280/642 |
| 2004/0149520 | A1 * | 8/2004 | Taylor et al. | 187/203 |

* cited by examiner

*Primary Examiner*—Gene C. Crawford
*Assistant Examiner*—Terrell Matthews
(74) *Attorney, Agent, or Firm*—Wood, Phillips, Katz, Clark & Mortimer

(57) ABSTRACT

A lift with a multiple locking position safety leg includes a lift bed for engaging in objects to be lifted together with a fluid cylinder to be connected to the lift bed and extendable and retractable to move the lift bed between two extreme positions including a fully lowered position and a fully raised position. A latching mechanism is provided for holding the lift bed in any of a plurality of positions between the extreme positions and includes a plurality of vertically spaced latches operated by gravity to move to latching positions, one for each of the plurality of positions, and a single actuator for simultaneously moving and holding each of the latches against gravity from the latching positions to allow the lift bed to be moved to the fully lowered position. Also disclosed is a kit for retrofitting existing lifts with the safety leg.

10 Claims, 3 Drawing Sheets

MULTIPLE LOCKING POSITION SAFETY LEG FOR LIFTS

FIELD OF THE INVENTION

This invention relates to lifts for elevating heavy objects as, for example, vehicular lifts, and more particularly, to a safety leg for use in such lifts to prevent the lifts from inadvertently descending.

BACKGROUND OF THE INVENTION

Lifts have long been utilized for elevating heavy objects for any of a large variety of purposes. One potential hazard associated with any type of lift is that the same will inadvertently descend as a result of malfunction or human error. If a person or an object is under the lift at such a time, injury to the person or damage to the object are likely to occur, particularly when the lift is bearing a load.

One common form of a lift is that utilized for vehicle repair. Such lifts are commonly found in service stations, the service departments of vehicle dealers, and the places of business of vehicle mechanics. In recognition of the potential dangers posed by inadvertent descent of vehicular lifts, The Automotive Lift Institute of Indialantic Fla., at least as early as 1998, promulgated the following standard which in turn has been approved by The American National Standards Institute of New York, N.Y. The standard is as follows:

8.2.11 Load Holding Device

All automotive lifts except screw drive systems shall incorporate a mechanical device to prevent downward movement of more than 6" (6 inches) after stopping motion. Function shall begin within twenty-four (24) inches of rise, and shall continue to the full rise position. If latches do not automatically reset after disengagement to prevent lowering the load, then the lifts shall incorporate a warning label at the point of latch operation and at the point of lift operation, that states that the latches do not automatically reset after lowering. The printed materials furnished with the lift shall incorporate the same warning.

In practice, The Occupational Safety and Health Agency (OSHA) inspects places of vehicular lift use such as those identified above for compliance with the foregoing industry developed standard.

A particularly vexing difficulty occurs when lifts not meeting the foregoing standard are found. The owner/operator of the lift is then required to bring the lift into compliance, frequently at considerable expense.

For example, a common type of lift used for vehicular purposes is the well-known in-ground lift. Such lifts typically include a lift bed having a pair of spaced parallel rails engageable with the frame of a vehicle and connected by a cross brace typically referred to as the superstructure.

A hydraulic cylinder is located wholly within an excavation within the facility housing the lift and arranged so that its piston end is connected to the superstructure and moves the superstructure, and thus the lift bed, between a fully lowered position, resting on the underlying terrain and an elevated position, typically sufficiently high that an adult may walk, substantially unimpeded, beneath the lift.

Such lifts have also been typically provided with so called antirotation tubes which are cylindrical tubes connected to the superstructure in depending relation and located parallel to the lift cylinder. A tube is located in the excavation housing the lift cylinder and the antirotation tube is set to telescope into and out of such tube.

Of course, when excavation is required to remedy the deficiency, considerable expense is involved both in breaking the typical concrete floor and excavating below it, and then filling the excavation and replacing the floor once the upgrade is complete.

In one prior art structures, a single latch, and actuator therefor has been located on the antirotation tube so as to latch the lift and prevent descent more than a few inches below its uppermost position Though the prior art design utilizing a single latch does allow replacement of a conventional antirotation tube with one provided with a single latch without the need for excavation or the like, the same structure does not provide for a limiting of inadvertent downward moment of more than 6" for all lift position above 24 inches of rise.

The present invention is directed to overcoming the foregoing problems.

SUMMARY OF THE INVENTION

It is the principal object of the invention to provide a hew and improved safety leg for a lift. More specifically, it is an object of the invention to provide a multiple locking position safety leg. It is also an object of the invention to provide a kit for retrofitting lifts with a multi-locking position safety leg as well as to provide a lift with a multiple locking position safety leg.

According to one facet of the invention, the above objects are accomplished in the kit for retrofitting an in-ground lift having an antirotation tube with a load holding device. The kit includes an elongated, cylindrical tube having the same outer diameter as an antirotation tube for the lift. A nut is connected to the tube at one end thereof and a plurality of first slots are spaced at predetermined locations in one side of the tube. A plurality of second slots are located generally in alignment with corresponding ones of the first slots and located in the side of the tube opposite the one side. An additional slot is provided in the opposite side between the nut on the one hand and the second slots on the other. A plurality of elongated dogs each having a length greater than the outside diameter of the antirotation tube, are provided, one for each aligned pair of the first and second slots. A plurality of pivot pins, one for each dog are provided within the interior of the tube and each journals an associated dog for rotation about an axis mutually transverse to the tube and a corresponding one of the aligned pairs of slots between a first position actuator within the tube and a second position wherein opposite ends of the dog extend out of both the first and second slots of the associated pair. The rotational axis and/or the dogs are further such that each dog has more mass between the rotational axis at one end of the dog than the other end. A manual actuator is pivoted within the tube and is moveably between a first position within the tube and a second position extending exterior of the tube. A linkage connects the actuator on each of the dogs and is moveable in response to movement of the actuator to the actuator second position to allow movement of the dogs from the second position of the dogs toward the first position of the dogs and is further responsive to movement of the actuator towards the actuator first position to allow the dogs to move toward the second position thereof.

In a preferred embodiment, the linkage includes an elongated, generally rigid link mounted for reciprocal movement within the tube and a plurality of cams are spaced along the length of the link at positions where at they may be brought into engagement with a corresponding one of the dogs to one side of the corresponding axis.

One embodiment of the invention contemplates that the link and the cams be located so as to engage each dog between its axis and its other end so as to positively move each dog toward the dog first position while allowing each dog to be biased towards the dog second position by gravity.

In a highly preferred embodiment, the link and the cams are defined by a ladder-like structure.

Preferably, the actuator is connected to the link by lost motion connection.

According to another facet of the invention there is provided a lift that includes a lift bed for engaging an object to be lifted. A fluid cylinder is connected to the lift bed and is extendable and retractable to move the lift bed between two extreme positions including a fully lowered position and a fully raised position. The invention further contemplates the inclusion of a latching mechanism for holding the lift bed in any of a plurality of positions between the extreme positions including a plurality of vertically spaced latches operated by gravity to move to latching positions, one for each of the plurality of positions. Also provided is a single actuator for simultaneously moving and holding each of the latches against gravity from the latching position to allow the lift bed to be moved to the fully lowered position.

In a preferred embodiment, each of the latches is a dog pivoted about a substantially horizontal axis and the single actuator includes a lever having a lost motion connection to each of the dogs.

In a preferred embodiment, the lift is an in-ground lift and the cylinder is generally below ground when the lift bed is in the fully lowered position. An elongated, antirotation tube is connected to the lift bed for movement therewith and is parallel to the cylinder. A below ground tube is provided to telescopically receive the antirotation tube and is located parallel to the cylinder and has an open end at about ground level. The lever includes a manually operable end. The dogs and the lever are pivoted to the antirotation tube and moveable between positions only within the antirotation tube and positions projecting outwardly of the antirotation tube and are constructed to be cammed into the antirotation tube when the actuator has been operated to move the dogs out of the latching positions by engaging with the ground and ground level or with the open end of the below ground tube.

More preferably, the lost motion connection includes a link within the antirotation tube which is vertically moveable by the lever and has a plurality of engagement projections, one for each dog, for engaging the associated dog in response to actuation of the lever so as to move and hold the latches against gravity from the latching positions.

In a preferred embodiment, the engagement projections are free of connections to the dogs.

Other objects and advantages will become apparent from the following specification taken in connection with the accompanying drawings.

DESCRIPTION OF PREFERRED EMBODIMENT

An exemplary embodiment of the invention will be described in the context of use in an in-ground lift having an antirotation tube. However, it is to be understood that the invention is not so limited. That is to say, the invention will find applicability in above ground lifts and in structures other than antirotation tubes. Hence, no limitations to in-ground lifts and/or antirotation tubes is intended except insofar as expressly stated in the appended claims.

Figure 1:
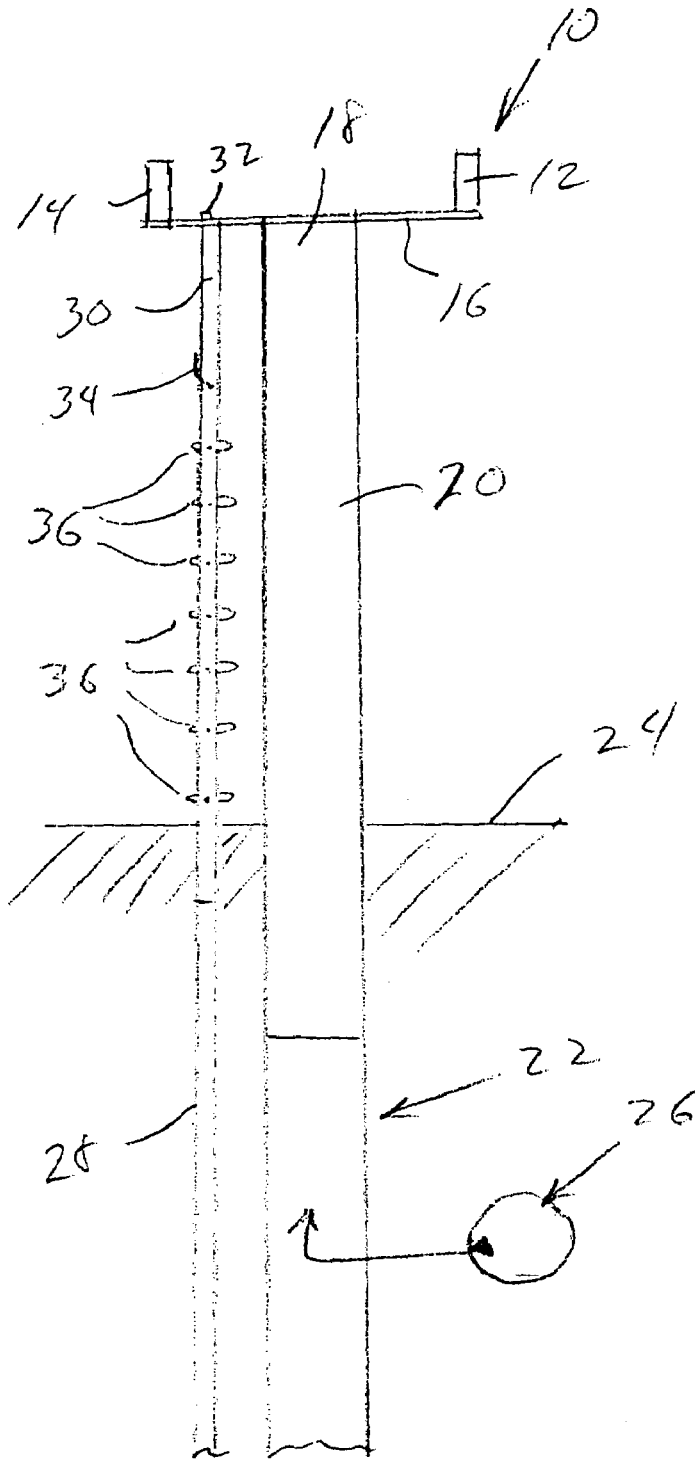
FIG. 1 is a somewhat schematic, elevational view of an in-ground lift incorporating a multiple position locking system made according to the invention.

Referring now to FIG. 1, an in-ground lift embodying the invention is illustrated and is seen to include a lifting bed, generally designated 10, having two parallel rails 12 and 14 which may engage the underside of the frame of a vehicle to be elevated. The rails 12, 14 are connected to one another by a superstructure 16 of conventional construction. The superstructure 16 is connected to the upper end 18 of a piston 20 of a hydraulic cylinder, generally designated 22. The cylinder 22 is located below ground level shown at 24 in FIG. 1. A conventional pumping system, generally designated 26, is employed to pressurize the lower end of the piston 20 and drive the same upwardly to any of several elevated positions, including the position shown in FIG. 1 which is an uppermost position. The piston 20 may also be lowered into the cylinder 22 to a lowermost position, not shown, whereat the superstructure 16 will be essentially resting on the ground at ground level 24.

A guide tube 28 is located below ground level and is located parallel to the cylinder 22. The guide tube 28 receives an antirotation tube 30 in a telescoping fashion. The upper end of the antirotation tube 30 is connected by a bolt 32 to the superstructure 16 in a conventional fashion.

According to the invention, the antirotation tube 30 includes a single manual actuator 34 and a plurality of latches 36 in the form of dogs in vertically spaced relation. As illustrated in FIG. 1, the dogs 36 are in a latching position so that should the piston 20 begin to descend, one of the latches 36 will engage the ground at ground level 24 or the upper end of the guide tube 28 to block further descent. This construction is shown in greater detail in FIG. 2 wherein the upper end of the guide tube 28 is given the reference numeral 38. It will be seen that the bolt 32 is threaded into a nut 40 contained within the upper end 42 of the antirotation tube 30.

Figure 2:
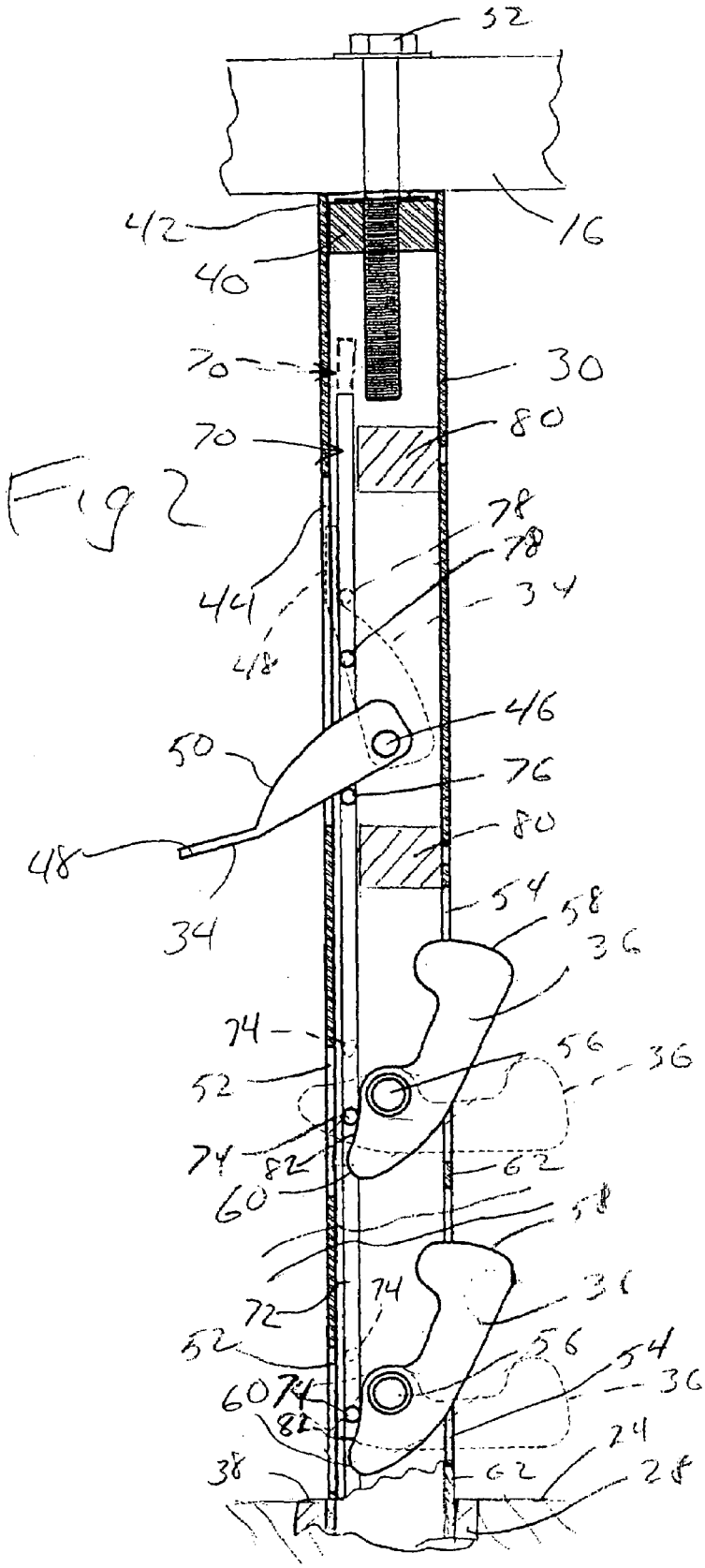
FIG. 2 is an enlarged, fragmentary, broken vertical section of the locking mechanism as contained in an antirotation tube.
Figures 3, 4, 5, 6:
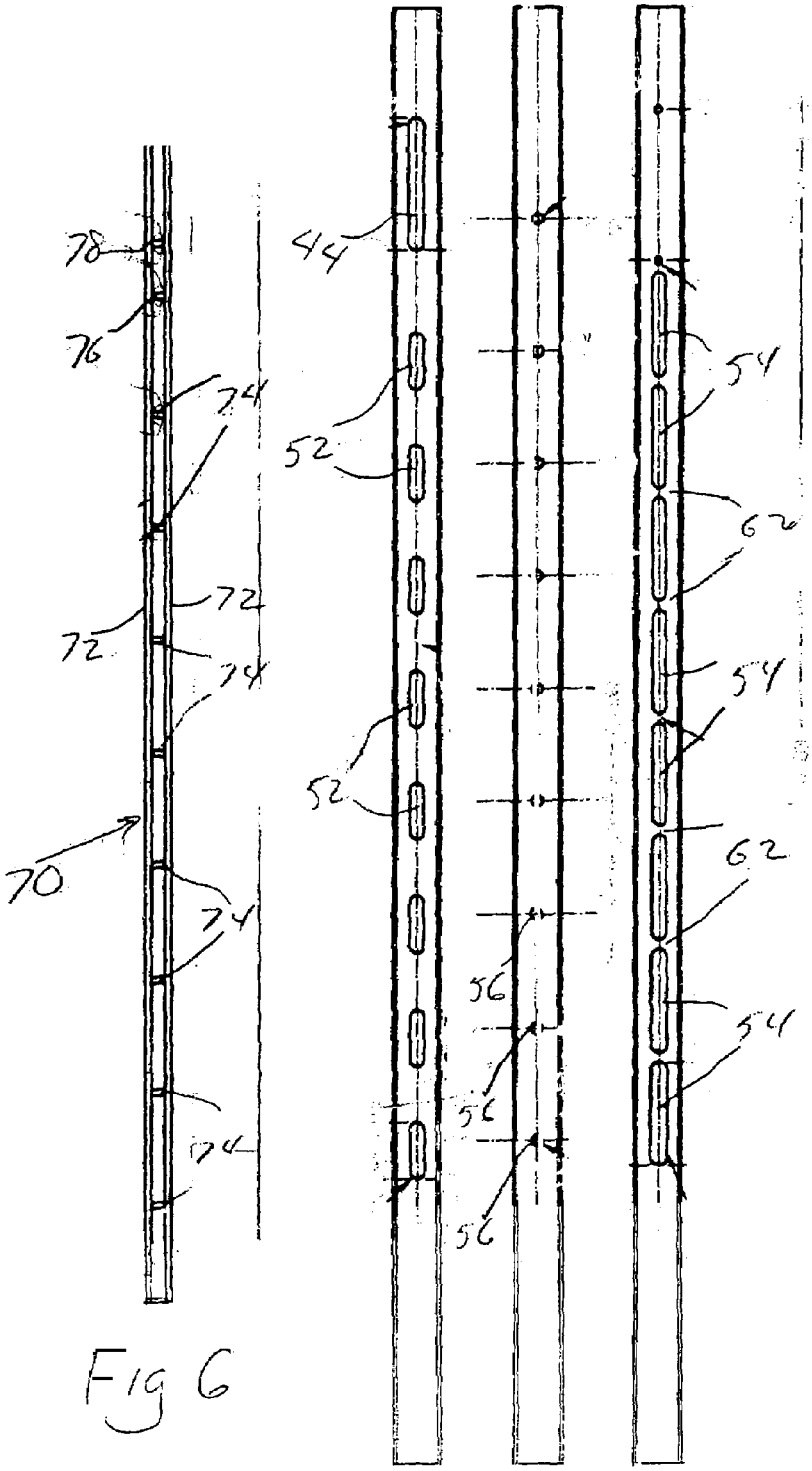
FIG. 3 is a view of an antirotation tube from one side thereof.
FIG. 4 is a view of the antirotation tube from the opposite side thereof.
FIG. 5 is a view taken at 90° to either of the views of FIG. 3 or FIG. 4.
FIG. 6 is an elevation of a link utilized in the locking mechanism.

The antirotation tube, at a location closely proximate to the nut 40 contains an elongated slot 44 as seen in both FIG. 2 and FIG. 3. The actuator 34, which is in the form of a lever, is moveable between the solid and dotted line positions illustrated in FIG. 2 by pivoting around a pivot pin 46 impaled in the tube 30. It is to be noted that the upper side of the lever actuator 34 includes a gripping end 48 which may be manually grasped by an operator and which flows into a cam surface 50 for purposes to be described.

Below the slot 44 there are pairs of slots 52 and 54 formed in opposite sides of the wall of the antirotation tube 30. The slots 52 are also visible in FIG. 3 while the slots 54 are visible in FIG. 4.

As noted, the slots are paired and are aligned across from one another within the wall of the tube 30 and are located on six inch or less centers along the length of the antirotation tube 30.

The dogs 36 are placed on pivot pins 56 carried by the antirotation tube 30 and located between the slots 52 and 54 of each pair so that the dogs 36 may pivot to the dotted line position illustrated in FIG. 2 or may be pivoted counter clockwise as viewed in FIG. 2 to wholly enter the interior of the antirotation tube 30. FIG. 5 illustrates the relative position of the pivot location 56 in relation to the slots 52 on the one hand and slots 54 on the other.

It will be observed that the pivot pins 56 are located between the ends 58 and opposite ends 60 of the dogs 36 and define pivot axes that are mutually transverse to the elongated axis of the tube 30 and the alignment of the slots 53 and 54 of each pair. It will also be noted that the pivot point for each dog is closer to the ends 60 than to the ends 58 and that the ends 58 are enlarged so that there is more mass in each dog 36 from the pivot pin 56 to the end 58 than from the pivot pin 56 to the end 60. It will also be observed that the pivot pins 56 are mounted closely adjacent an upper edge of each of the dogs 58. As a consequence of this, gravity will cause the dogs to pivot toward the dotted line position shown in FIG. 2. Webs 62 (see also FIG. 4) between the slots 54 act as stops to prevent the dogs 36 from moving substantially beyond the dotted line positions illustrated in FIG. 2.

When the dogs 36 are in the dotted line positions, both ends 58 and 60 will extend outwardly of the tube 30, that is, project to opposite sides thereof. As a consequence, should there be an inadvertent descent of the piston 20, the ends 58 and 60 will jam against the upper end 38 of the guide tube 28 or the ground level (as for example, a concrete or metal base) and provide support for the superstructure 16, thereby preventing further descent. And, of course, this will occur at any position of the piston 20 above the ground level 24 if at least one of the dogs 36 is in the dotted line position shown in FIG. 2 and above the upper end 38 of the guide tube 28.

By placing the pivots on centers that are no more than 6" apart, the previously quoted industry standard requiring prevention of more than 6" of movement is met. Of course, other spacing could be used if desired. And by placing the uppermost dog 36 such that it will move to the dotted line position before twenty-four inches of rise of the lift has occurred, that requirement of the standard is likewise met.

To allow for controlled lowering of the lift, the actuator 34 is employed. As will be seen, when the actuator 34 is in its dotted line position as shown in FIG. 2, the dogs 36 rotate under the influence of gravity to the dotted line positions illustrated in FIG. 2 to provide for position locking after no more than 6" of movement. However, when it is desired to intentionally lower the lift, the actuator is moved counter-clockwise as shown in FIG. 2 about the pivot 46 to the solid line position.

Within the antirotation tube is an actuator link, generally designated 70.

The link 70 is a ladder like structure as can be seen from FIG. 6 and includes a pair of spaced, parallel side pieces 72 interconnected by camming pins 74, one for each of the dogs 36. Above the uppermost camming pins 74 are a pair of pins 76 and 78 which loosely sandwich the cam surface 50 of the actuator lever 34 to provide a lost motion connection therewith. This is best seen in FIG. 2. The link 70 is quite narrow and is disposed within the antirotation tube 30 in close proximity to the side thereof containing the slot 52 and the slot 44. Guide blocks 80 are placed in the positions illustrated in FIG. 2 to confine the link 70 while guiding it for reciprocal movement in close proximity to that part of the wall of antirotation tube 30 having the slots 44 and 52.

Turning to the dogs 36, the same, between the pivots 56 and the ends 60, include a slightly concave cam surface 82 which may be engaged by a corresponding one of the camming pins 74. When so engaged, and when the link 70 is moved downwardly, assuming that the dogs 36 are not jammed against the upper end 38 of the guide tube 28 or the ground 24, the dogs 36 can be moved to the solid line position illustrated in FIG. 2 whereat at least one of the ends 58 and 60 is totally within the antirotation tube 30. Thus, the dogs 36 are no longer in latching positions and the lift may be lowered. During such lowering, the dogs 36 will be progressively cammed into the interior or the antirrotation tube 30 by the upper end 38 of the guide tube 28 or the ground 24.

If the link 70 is lifted to its dotted line position as shown in FIG. 2, it will be appreciated that the camming pin 74 will move upwardly to the dotted line position illustrated in FIG. 2 and essentially out of engagement with the cam surface 82 of each one of the dogs 36. Under the influence of gravity, the dogs 36 then pivot to the dotted line position illustrated in FIG. 2. Such movement of the link 70 is accomplished through manual actuation of the single actuator 34. The gripping end 48 is grasp by the operator who will pivot the lever 34 in a clockwise direction as viewed in FIG. 2. The cam surface 50 will engage the cam pin 78 and move it to the dotted line position illustrated in FIG. 2, thereby elevating the link 70 to cause the action mentioned previously.

On the other hand, when it is desired to set the device for latching, the operator takes the opposite action by pivoting the lever 34 in a counter-clockwise direction whereupon it will eventually engage the cam pin 76 to allow the link to drop or to drive the link downwardly, causing the camming pin 74 to engage the cam surfaces 82 and move the dogs to a non latching position and hold the same in that location.

In operation, the cylinder 22 is pressurized to elevate the lift to the desired height. At this time, the actuator lever 34 will be in its dotted line position wholly within the antirotation tube 30 by reason of being cammed into such position upon the previous lowering of the lift when the upper end 38 of the guide tube 28 strikes the underside. As a consequence, as each dog 36 rises above the end 38 of the guide tube 28 during the elevating process, it will move to its dotted line position as illustrated in FIG. 2, that is, the locking position, to prevent more than 6" of downward movement in accordance with the standard. Thus, there is automatic resetting of the dogs 36 to their latching position, obviating any need for the warning labels specified by the standard which could be ignored by a careless lift operator.

When it is desired to lower the lift, the operator need only move the actuating lever 34 from the dotted line position illustrated in FIG. 2 to the solid line position. This will urge the link 70 downwardly to pivot the dogs 36 to the solid line position. Lowering of the link will cause the dogs 76 to enter the interior of the antirotation tube 30 as they sequentially engage the upper end 38 of the guide tube 28 or the ground 24.

Installation of the apparatus in an in-ground lift having an antirotation tube is readily accomplished to the point where the assembled antirotation tube may be sold as a kit to retrofit existing lifts. It is only necessary to elevate the lift bed 10 a few feet above the ground. The bolt 32 may then be removed to loosen the existing antirotation tube from the superstructure 16. Suitable care is taken to prevent the existing antirotation tube from dropping into the guide tube 28.

The lift bed 10 is then rotated about the vertical axis of the cylinder 20 sufficiently so that the upper end of the existing antirotation tube is clear of the superstructure 16 where upon the existing antirotation tube may be fully removed from the guide tube 28. At this time, the new antirotation tube 30 provided with a multiple locking position means of the invention, is inserted into the guide tube 28 and partially lowered therein. The superstructure 16 is then pivoted to overlie the tube 30 of the invention whereupon the bolt 32 is reinstalled and the system is ready to operate. In the usual case, the retrofit can be accomplished in 10 minutes or less.

From the foregoing, it will be appreciated that a multiple locking position safety leg made according to the invention is ideally suited for its intended purpose. The same provides full compliance with the applicable standard in that the multiple dogs 36 are provided to allow no more than 6" of downward movement before lockup occurs. At the same time, the apparatus is automatically resetting insofar as when the lift is intentionally lowered, ultimately, the single actuating lever 34 is cammed into a position that releases the dogs 36 to move to locking positions as they emerge from the guide tube 28.

The structure is relatively inexpensive, easily installed and in full compliance with applicable standards.

The invention claimed is:

1. A kit for retrofitting an in ground lift having an antirotation tube with a load holding device, comprising:

an elongated, cylindrical tube;

a nut connected to said tube at one end thereof;

a plurality of first slots spaced at predetermined locations in one side of said tube;

a plurality of second slots spaced generally in alignment with corresponding ones of said first slots and located on a side of said tube opposite said one side;

an additional slot in said opposite side and between said nut on the one hand and said second slots on the other hand;

a plurality of elongated dogs each having a length greater than said outside diameter, one for each aligned pair of said first and second slots;

a plurality of pivot pins, one for each dog, within the interior of said tube and each journaling an associated dog for rotation about an axis mutually transverse to said tube and a corresponding one of said aligned pairs of slots between a first position wholly within said tube and a second position wherein opposite ends of said dogs extend out of both the first and second slots of the associated pair, said axis and/or said dogs further being such that each dog has more mass between said axis and one end of the dog than the other end;

a manual actuator pivoted within said tube and movable between a first position within said tube and a second position extending exteriorly of said tube and a linkage connecting said actuator and each of said dogs and movable in response to movement of said actuator to said actuator second position to allow movement of said dogs from said dog second positions toward said dog first positions, and responsive to movement of said actuator toward said actuator first position to allow said dogs to move toward said dog second positions.

2. The kit of claim 1 wherein said linkage includes an elongated rigid link mounted for reciprocal movement within said tube, and a plurality of cams spaced along the length of said link at positions whereat they may be brought into engagement with a corresponding one of said dogs to one side of the corresponding axis.

3. The kit of claim 2 wherein said link and said cams are located so as to engage each said dog between its axis and its said other end to positively move each said dog toward said dog first positions while allowing each dog to be biased toward said dog second position by gravity.

4. The kit of claim 3 wherein said actuator is connected to said link by a lost motion connection.

5. The kit of claim 2 wherein said actuator is connected to said link by a lost motion connection.

6. A kit for retrofitting an in ground lift having an antirotation tube with a load holding device, comprising:

an elongated, cylindrical tube;

a plurality of first slots spaced at predetermined locations in one side of said tube;

a plurality of second slots spaced generally in alignment with corresponding ones of said first slots and located on a side of said tube opposite said one side;

a plurality of elongated dogs each having a length greater than said outside diameter, one for each aligned pair of said first and second slots;

a plurality of pivot pins, one for each dog, within the interior of said tube and each journaling an associated dog for rotation about an axis mutually transverse to said tube and a corresponding one of said aligned pairs of slots between a first position wholly within said tube and a second position wherein opposite ends of said dogs extend out of both the first and second slots of the associated pair, said axis and/or said dogs further being such that each dog has more mass between said axis and one end of the dog than the other end;

a manual actuator pivoted within said tube and movable between a first position within said tube and a second position extending exteriorly of said tube and a linkage connecting said actuator and each of said dogs and movable in response to movement of said actuator to said actuator second position to allow movement of said dogs from said dog second positions toward said dog first positions, and responsive to movement of said actuator toward said actuator first position to allow said dogs to move toward said dog second positions.

7. The kit of claim 6 wherein said linkage includes an elongated rigid link mounted for reciprocal movement within said tube, and a plurality of cams spaced along the length of said link at positions whereat they may be brought into engagement with a corresponding one of said dogs to one side of the corresponding axis.

8. The kit of claim 7 wherein said link and said cams are located so as to engage each said dog between its axis and its said other end to positively move each said dog toward said dog first positions while allowing each dog to be biased toward said dog second position by gravity.

9. The kit of claim 8 wherein said actuator is connected to said link by a lost motion connection.

10. The kit of claim 7 wherein said actuator is connected to said link by a lost motion connection.

* * * * *